US005363921A

United States Patent [19]

Mendez

[11] Patent Number: 5,363,921

[45] Date of Patent: Nov. 15, 1994

[54] WIRELINE PULL DISCONNECT

[75] Inventor: Luis E. Mendez, Houston, Tex.

[73] Assignee: Baker Hughes, Inc., Houston, Tex.

[21] Appl. No.: 55,848

[22] Filed: Apr. 30, 1993

[51] Int. Cl.[5] ..... E21B 23/00

[52] U.S. Cl. ..... 166/377; 166/123

[58] Field of Search ..... 166/377, 381, 382, 123, 166/208, 217

[56] References Cited

U.S. PATENT DOCUMENTS 4,295,528 10/1981 Carmody ..... 166/381
4,715,445 12/1987 Smith, Jr. ..... 166/377
4,793,411 12/1988 Zunkel ..... 166/377 X
4,796,707 1/1989 Halbardier ..... 166/123 X

*Primary Examiner*—Michael Powell Buiz
*Attorney, Agent, or Firm*—Rosenblatt & Associates

[57] ABSTRACT

A wireline pull disconnect is enclosed which operates using a system of trapped collets. The collets are releasable by a pulling force which is resisted by one or more Belleville washers. Upon the exertion of a predetermined force which will flatten the Belleville washers, sufficient movement of the components of the pull disconnect occurs so that the collets become liberated and disconnection is effected.

15 Claims, 2 Drawing Sheets

WIRELINE PULL DISCONNECT

FIELD OF THE INVENTION

The field of the invention relates to devices for disconnection downhole, more specifically oriented toward wireline applications.

BACKGROUND OF THE INVENTION

During oilfield operations, tubing or wireline or electric line can be used to place a wide variety of downhole tools in a wellbore. A disconnect mechanism is necessary should the equipment being run into the well become stuck. While a tubing string can withstand substantially higher extraction forces than wireline or electric line, many times operators prefer to run wireline because it saves substantial rig time in getting the downhole tools positioned properly in the wellbore. In the past, disconnect mechanisms have been provided which primarily rely on shear pins. Since wireline or electric line has fairly low tensile capabilities with respect to a tubing string, the shear screw or screws used in the prior art had to be set at a fairly low shear rating. The low shear rating was necessary to prevent damage to the wireline or electric line from excessive tensile stress should the downhole tool become stuck in the wellbore.

However, problems have been encountered using a shear screw or screws that have a low failure point. During normal operation, the shear screws are exposed to various cyclical forces which tend to affect their ultimate shear rating. The shear screws are also exposed to the fluids in the wellbore which also over time can affect the inherent strength of the shear screws or pins, making them susceptible to failure at stresses below their rated failure point. Unexpected release can significantly delay operations, thereby costing the well operator significant sums due to the delays incurred. Unexpected release of a release mechanism can also result in loss of the downhole tool in the wellbore and in extreme cases can cause severe damage to the wellbore, which requires substantial time and money to repair.

It has long been desired in wireline or slickline applications to have a release mechanism that will predictably release with a known preset force. Such a release mechanism would ideally be able to provide numerous cycles of operation, with reliability of performance so that premature release would not occur. One of the objects of the present invention is to provide a simple, easy-to-construct release mechanism which will operate reliably at a desired release force. Another object of the present invention is to provide a simply constructed release mechanism which is so configured as to be substantially unaffected by the wellbore conditions or prior cycles of loading. Another object of the invention is to provide a simply constructed release mechanism which can be easily reused without significant disassembly and reassembly.

SUMMARY OF THE INVENTION

A wireline pull disconnect is enclosed which operates using a system of trapped collets. The collets are releasable by a pulling force which is resisted by one or more Belleville washers. Upon the exertion of a predetermined force which will flatten the Belleville washers, sufficient movement of the components of the pull disconnect occurs so that the collets become liberated and disconnection is effected.

DETAILED DESCRIPTION OF THE PREFERRED EMBODIMENT

Figure 1:
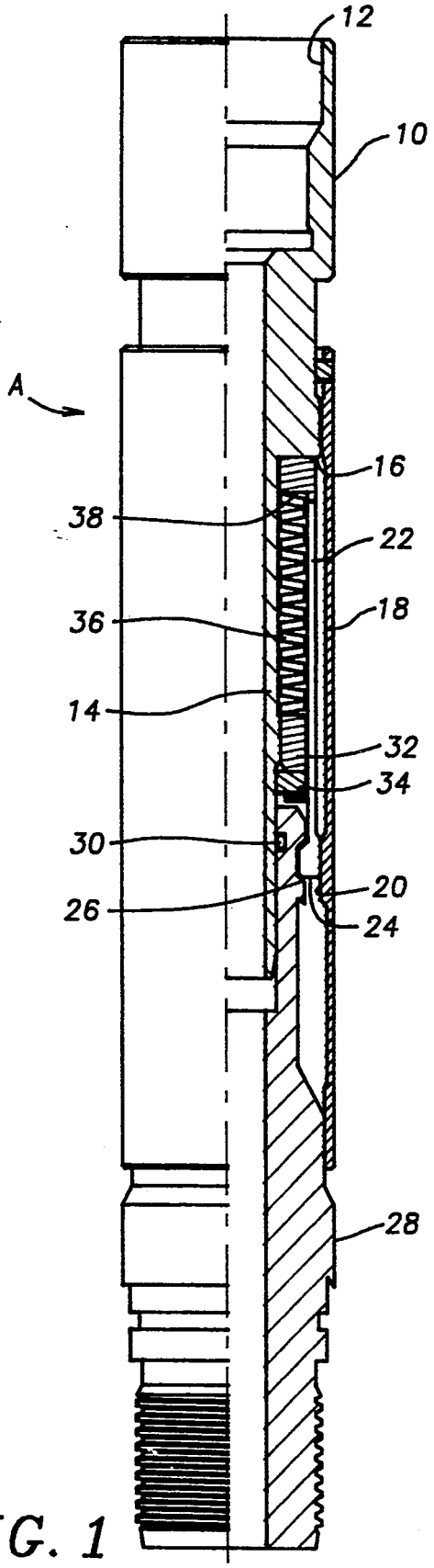
FIG. 1 is a sectional elevational view of one of the embodiments of the present invention, showing the collets in the trap position.

The apparatus A is shown in FIG. 1 in the run-in position. The apparatus A has a mandrel 10, with a connection 12 to accommodate a wireline or electric line in a known manner. The mandrel 10 extends longitudinally into an inner sleeve segment 14. Inner sleeve 14 forms a shoulder 16. Attached to mandrel 10, preferably by a threaded connection, is outer sleeve 18. Outer sleeve 18 has a raised surface 20. Located between inner sleeve 14 and outer sleeve 18 is collet ring 22, which has a plurality of collet heads 24. In the run-in position shown in FIG. 1, collet heads 24 are trapped in recess 26 of lower housing 28 by virtue of raised surface 20 abutting collet heads 24.

Inner sleeve 14 is movable with respect to lower housing 28. The interface between inner sleeve 14 and lower housing 28 is sealed off by seal 30. Also connected to inner sleeve 14 is ring 32, which is preferably threaded to inner sleeve 14, with set screw 34 holding the threaded connection. Above ring 32 is a plurality of Belleville washers 36. The Belleville washers 36 are disposed between ring 32 and collet ring 22. The Belleville washers 36 bear on surface 38 of collet ring 22. In the preferred embodiment, a plurality of Belleville washers 36 are stacked up. The washers can be preselected so that a predetermined applied force will be necessary in order to initiate movement of mandrel 10 and, in conjunction with it, outer sleeve 18. Preferably, washers that require a force of about 1400 lbs. applied at the surface to the wireline can be selected. The washers can be arranged in series, opposing each other or in parallel, arranged in the same direction. When in series, the force to deform them all is unaffected by the number in the stack. When in parallel, the force required to flatten the washers increases with the addition of each washer. The number of washers 36 in the stack can be predetermined on the basis of the amount of travel desired for raised surface 20. The initial position of raised surface 20 with respect to collet heads 24 can be adjusted since there is a threaded connection between outer sleeve 18 and mandrel 10. Depending on the degree that the threaded joint between outer sleeve 18 and mandrel 10 is made up, the initial position of raised surface 20 will vary. Those skilled in the art will appreciate that the necessary distance that raised surface 20 must be moved to release the collet heads 24 will also vary, depending upon the final make-up of the threaded joint between outer sleeve 18 and mandrel 10. While a threaded joint is illustrated for the connection between outer sleeve 18 and mandrel 10, other types of connections that allow for variability of placement of the components connected is within the scope of the invention. Since in the preferred embodiment the Belleville washers 36 are in a vertical stack, the number of washers does not alter the required force to get mandrel 10 moving. Those skilled in the art will appreciate that when lower housing 28 becomes stuck in the wellbore by virtue of its attachment to a stuck downhole tool, the procedure as illustrated allows disconnection of the mandrel 10 from lower housing 28.

Figure 2:
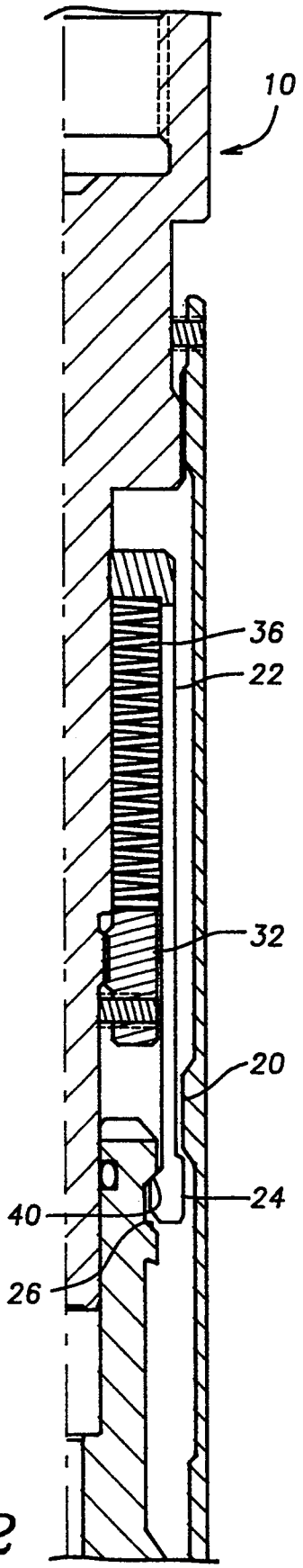
FIG. 2 is the view of FIG. 1, showing the wireline pull disconnect assembly with a pulling force applied and the collets about to be released.
Figure 3:
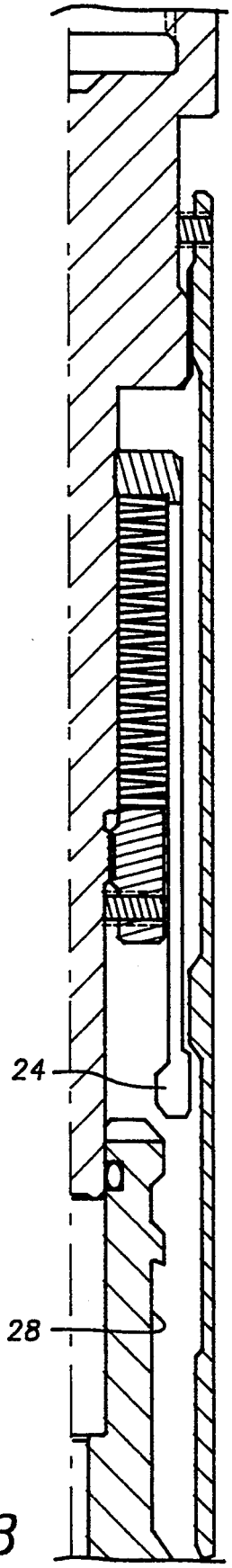
FIG. 3 is the view of FIGS. 1 and 2, with the collets fully released.

The disconnection is illustrated by comparing FIG. 1 to FIGS. 2 and 3. In FIG. 2, the raised surface 20 has been elevated and the Belleville washers 36 have begun to be compressed. The collet heads 24 are no longer trapped by raised surface 20 and can be ramped radially outwardly on tapered surface 40. As can be seen by comparing FIG. 1 to FIG. 2, the Belleville washers 36 have been compressed to allow mandrel 10 to move upwardly. The compression actually occurs when ring 32 shifts upwardly while collet ring 22 is held in position until the collet heads 24 are disengaged from groove or recess 26. Once the collet heads 24 are released, the force compressing Belleville washers 36 is released, and the stack of Belleville washers 36 relaxes to the position shown in FIG. 3. At that time, the collet heads 24 have cleared recess 26, and mandrel 10 can be lifted away from lower housing 28.

Figure 4:
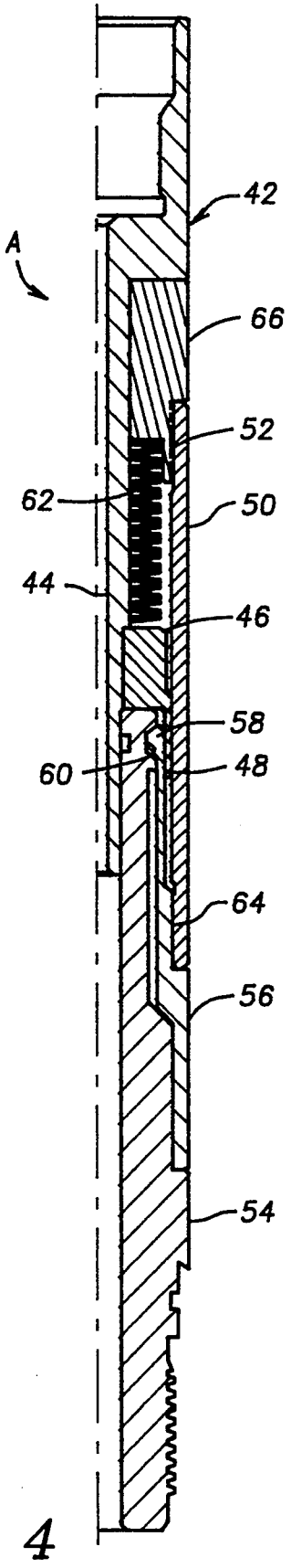
FIG. 4 is a sectional elevational view of an alternative embodiment of the present invention.

FIG. 4 illustrates an alternative embodiment which operates similarly in principle but has a different layout of the components. The embodiment shown in FIG. 4 does not have the adjustability feature for its outer sleeve, as will be described below. The apparatus A shown in FIG. 4 has mandrel 42 to which a wireline or electric line can be attached (not shown). The mandrel 42 has an extension segment which forms an inner sleeve 44. Ring 46 is threadedly connected to sleeve 44. Ring 46 has a longitudinal extension segment 48. Outer sleeve 50 is threadedly connected to ring 66 at thread 52. Lower housing 54 is at the bottom of the assembly and, when it comes time for the assembly A to operate, is the component that is stuck in the wellbore by virtue of its attachment to a stuck downhole tool. Mounted to lower housing 54 is collet ring 56, which has a plurality of collet heads 58. The collet heads 58 are trapped in recess 60 in the run-in position shown in FIG. 4. Extension segment 48 holds collet heads 58 trapped in recess 60. A plurality of Belleville washers 62 are stacked between inner sleeve 44 and outer sleeve 50. The quantity of washers used can be varied without departing from the spirit of the invention. Different ranges of motion of extension segment 48 will necessitate varying amounts of washers 62 in the stack. The washers preferably are selected to have a force requirement on the wireline (not shown) of approximately 1400 lbs. to flatten them. Other force ranges or settings can be used. Therefore, a 1400-lb. force applied to washers 62 through ring 46 will result in compaction of the washer stack 62 to allow mandrel 42 to come up and with it bring up extension segment 48. Once extension segment 48 moves up sufficiently to be clear of collet heads 58, the collet heads 58 become liberated from recess 60. The upward force exerted on mandrel 42 is transmitted to the washer stack 62 through ring 46. When collet heads 58 are no longer trapped in recess 60, the mandrel 42 is clear to separate from lower housing 54, and bring with it outer sleeve 50 with collet ring 56. It should be noted that collet ring 56 is threadedly connected to outer sleeve 50 at thread 64. Thread 52 connects outer sleeve 50 to ring 66.

To make the apparatus A shown in FIG. 4 release, an upward force is put on mandrel 42. The upward force on mandrel 42 translates into upward motion of ring 46, which tends to compress the Belleville washers 62 against ring 66. Ring 66 can't move until extension segment 48 liberates collet heads 58. As ring 46 comes up, extension segment 48 comes up as well. Ring 66 is then liberated and, by virtue of ring 46 and washers 62, comes up with mandrel 42. This lifts the collet heads 58 clear of recess 60.

The apparatus A of the present invention has numerous advantages over the prior designs which use shear pins. It can be reused without component replacement or complete disassembly. The performance of the washers 62 is predictable and reliable through many cycles. Exposure to downhole fluids does not significantly vary the force required to flatten the washers 62 and, hence, accomplish the release. The doubts and uncertainties of the prior designs' releasing prematurely are substantially eliminated with the apparatus of the present invention. Shear pins have proven to be less than reliable when the set force for release is at or near 1400 lbs. or less. The apparatus is simple to construct and does not require significant time in disassembly as was required in prior shear pin designs. The washers absorb shock and are, therefore, less affected by such loading as shear pins. Shear pins tend to fail at lower stress when subjected to cyclic loading.

The foregoing disclosure and description of the invention are illustrative and explanatory thereof, and various changes in the size, shape and materials, as well as in the details of the illustrated construction, may be made without departing from the spirit of the invention.

I claim:

1. A release apparatus for use downhole to allow release from a stuck object, comprising:

a housing;

retaining means on said housing for selectively retaining the object to said housing;

release means on said housing selectively movable with respect to said retaining means for selective defeat of said retaining means for release from the object;

biasing means mounted to said housings, said biasing means preventing operation of said release means to release from the object until a predetermined force applied to said housing is exceeded;

said biasing means, upon application of a predetermined force, changes sufficiently in dimension to allow movement of said release means with respect to said retaining means for release from the object.

2. The apparatus of claim 1, wherein:

said biasing means is elastically deformed to accomplish said change in dimension.

3. The apparatus of claim 2, wherein:

said biasing means is nested between said housing and said release means.

4. The apparatus of claim 3, wherein:

said biasing means comprises at least one biasing element.

5. The apparatus of claim 4, wherein:

said biasing means further comprises at least one beveled washer.

6. The apparatus of claim 5, wherein:

said retaining means comprises at least one collet;

said release means further comprises a shifting sleeve mounted to said housing.

7. The apparatus of claim 6, wherein:

said shifting sleeve is mountable to said housing in a plurality of initial positions for variation of movement range of said sleeve for release from said collet.

8. The apparatus of claim 1, wherein:

said release means is mountable to said housing in a plurality of initial positions for variation of movement range of said release means for release from said retaining means.

9. The apparatus of claim 6, wherein:

said retaining means comprises a plurality of collets extending from a ring;

said biasing means comprises a plurality of stacked beveled washers movable with said housing and said shifting sleeve upon application of a force on said housing, when said force is in excess of a predetermined amount, said collets are released upon sufficient movement of said sleeve responsive to deformation of said washers.

10. A method of releasing a downhole tool, comprising:

running a downhole tool into the well with a release mechanism;

applying a predetermined force to the release mechanism;

applying a predetermined resistive force acting on said mechanism;

creating relative movement within said release mechanism;

releasing the tool from the mechanism;

creating said resistive force using a biasing element;

using a least one beveled washer as the biasing element.

11. The method of claim 10, further comprising the steps of:

selectively retaining the downhole tool with at least one collet;

selectively releasing said collet by shifting a sleeve;

compressing said washer by initial movement of said sleeve.

12. The method of claim 11, further comprising the steps of:

providing adjustment of the mounting position of said sleeve with respect to a housing for the release mechanism;

matching the distance said sleeve must move for release of said collet to the dimensional change of said washer when subjected to a predetermined compressive force.

13. The method of claim 10, further comprising the step of:

running in the release mechanism and the downhole tool with a wireline.

14. The method of claim 13, further comprising the steps of:

setting the resistive force to about 1400 lbs.;

reusing the release mechanism after a release without component replacement.

15. An apparatus for selective release of a downhole tool, comprising:

a housing;

a detent mechanism on said housing for selective retention of the tool;

a sleeve mounted to said housing for selective relative movement with respect to said detent mechanism;

force means operably connected to said detent mechanism and said sleeve for preventing sleeve movement which releases the tool from said detent until a predetermined force is applied to said housing;

said force means further comprises at least one beveled washer.

* * * * *